US005351494A

United States Patent [19]

Jensen et al.

[11] Patent Number: 5,351,494

[45] Date of Patent: Oct. 4, 1994

[54] COOLER CHEST INSULATIVE BLANKET

[76] Inventors: Robert L. Jensen; Joanne E. Jensen, both of 3506 Chambersburg Ave., Duluth, Minn. 55811

[21] Appl. No.: 202,171

[22] Filed: Feb. 25, 1994

[51] Int. Cl.[5] ..... F25D 3/08

[52] U.S. Cl. ..... 62/60; 62/457.1; 62/372; 62/457.7; 220/530

[58] Field of Search ..... 62/457.1, 457.2, 457.7, 62/475.9, 459, 465, 371, 372, 60; 220/902, 529, 530

[56] References Cited

U.S. PATENT DOCUMENTS

| | | | |
|---|---|---|---|
| 2,149,412 | 3/1939 | Bangs | 62/60 |
| 2,631,439 | 3/1953 | Feigenbaum | 62/373 |
| 4,675,225 | 6/1987 | Cutler . | |
| 4,759,467 | 7/1988 | Byrne . | |
| 4,944,844 | 7/1990 | Marcinko . | |
| 4,972,529 | 11/1990 | Wolfson, Jr. . | |
| 5,022,101 | 6/1991 | Gosselin et al. . | |
| 5,105,970 | 4/1992 | Malone et al. . | |
| 5,154,309 | 10/1992 | Wischusen, III et al. . | |

*Primary Examiner*—John M. Sollecito
*Attorney, Agent, or Firm*—Richard C. Litman

[57] ABSTRACT

An insulated cooler for carrying perishables and cooling medium such as ice is improved to provide an extended period during which low temperatures are maintained. A sheet of flexible, synthetic insulation material is placed over the perishables and cooling medium. The sheet is pressed downwardly against the perishables and cooling medium, thus substantially conforming to the upper surface thereof. A dead space may be defined above the sheet and below the cover of the cooler. Preferably, the insulation material is air entrained polypropylene, which could be washed, is sufficiently flexible, and can be trimmed to fit the cooler. The insulation material is preferably folded into at least three thicknesses and trimmed to conform to either the footprint of the insulated cavity, or to an enlarged size, so that the outer edges of the material can be tucked down and about the perishables in the cooler.

16 Claims, 3 Drawing Sheets

COOLER CHEST INSULATIVE BLANKET

BACKGROUND OF THE INVENTION

1. Field of the Invention

The present invention relates to a flexible sheet of insulation material placed in a portable cooler for improving the insulation of perishables and the effectiveness of the cooling medium placed in the cooler.

2. Description of the Prior Art

Insulation of storage containers has resulted in numerous prior art inventions. Most of these are directed to containers of constant geometry. That is, floor, walls, and top are provided, defining an outer boundary, which remains constant with respect to the constituent boundary members regardless of the volume of the contents. Generally, material having superior insulation characteristics is incorporated into one or more boundary members.

U.S. Pat. No. 5,154,309, issued to Henry Wischusen III et al. on Oct. 13, 1992, describes an insulated shipping container which is intended to preserve perishables, such as seafood, with a cooling medium, such as ice. One element of the container is a U-shaped insulating blanket made from several strata of insulating material. This blanket, when the container is assembled, is sandwiched between inner and outer walls of other components, and improves insulation by preventing transfer of heat by conduction and convection. It should be noted that this blanket always bears against or is located immediately beneath a top wall member of the container.

Another shipping container is seen in U.S. Pat. No. 5,105,970, issued to Thomas G. Malone et al. on Apr. 21, 1992. An insulation member is made from a plural ply including a ply of polyethylene foam. The insulation member occupies a constant location within the container.

U.S. Pat. No. 5,022,101, issued to Jeffrey E. Gosselin et al. on Jun. 11, 1991, illustrates a thermal cover place over a spa. The cover is formed by a three ply lamination including a plastic film. Another cover is seen in U.S. Pat. No. 4,972,529, issued to Sidney K. Wolfson, Jr., on Nov. 27, 1990. This cover is made from, preferably, two plies of a plastic such as polypropylene.

U.S. Pat. No. 4,759,467, issued to Thomas R. Byrne on Jul. 26, 1988, discloses a liner for a cooler which prevents water originating from melted ice from commingling with perishables stored in the cooler. The liner has a floor, lateral walls, and an open top. Preferred constituent materials include extruded film of polyvinyl chloride, polyethylene, and the like.

A thermal insulating blanket for sealing an opening in a building is shown in U.S. Pat. No. 4,675,225, issued to William P. Cutler on Jun. 23, 1987. The blanket described therein is fiber filled and compressible, the interior communicating with the exterior, so that the fiber filling can be compressed and expanded.

The use of polyurethane in a blanket is seen in U.S. Pat. No. 4,944,844, issued to Joseph J. Marcinko on Jul. 31, 1990. The polyurethane is reinforced by synthetic fibers, and is not employed for insulation purposes.

None of the above inventions and patents, taken either singly or in combination, is seen to describe the instant invention as claimed.

SUMMARY OF THE INVENTION

The present invention is directed more specifically to portable coolers, typically employed to store and transport perishables at reduced temperatures. Such a cooler typically includes insulated floor, walls, and a cover, defining a single open cavity therein. The cover may or may not be hinged to the container and may or may not be insulated. The cavity holds both perishables, such as food, and a cold substance for absorbing heat, which will be referred to as a cooling medium hereinafter. Examples of cooling media include ice and packaged, commercial products intended to go through a freezing and melting cycle during each use. Perishables are variable in nature, having different sizes, shapes, weights, packaging, and other characteristics. They are generally placed in organized fashion within the cooler, and the cooling medium is advantageously placed therearound. It is frequently the case that the cooler is only partly filled, and a significant portion of the volume of the cavity is unused. Air circulating in this unused portion introduces heat to the contents by convection and conduction. Even when the container is filled, unacceptable heating may occur, particularly if the cover is not insulated.

A significant area of improvement of a cooler exists in preventing these heat gains.

Obviously, as illustrated by the prior art, increasingly complex, sophisticated, and expensive construction may be attempted in accomplishing this objective. However, it is the purpose of the present invention to provide the benefits listed above in the least complex and most inexpensive way.

To this end, the invention includes a flexible sheet of a sturdy, readily available material, which is advantageously arranged within a cooler so as to prolong the period during which low temperatures are maintained. The material is preferably a bulk material of good insulating characteristics, such as air entrained polypropylene material, polyurethane foam or a polyethylene material. This material is readily cut or otherwise trimmed to desired dimensions, is easily folded, and could be washed. It is therefore very practical for the typical consumer.

This material avoids the characteristics of compressibility, fiber construction, laminated construction, and attachment apparatus. It is purchased in bulk lots, cut as desired, and placed in the cooler.

Accordingly, it is a principal object of the invention to improve on the insulation characteristics of a conventional portable cooler.

It is another object of the invention partially to enshroud temperature sensitive contents of a cooler in flexible insulation material.

It is a further object of the invention to divide a portable cooler into main and secondary cool chambers, when the cooler is not completely filled.

Still another object of the invention is to minimize the volume of the main cool chamber, leaving minimal air around the contents thereof.

An additional object of the invention is to maximize the insulating value of a sheet of insulating material.

It is again an object of the invention to minimize the quantity of insulating material employed by arranging the same as efficiently as possible.

Yet another object of the invention is to provide a closed cell, organic foam insulation material.

Still another object of the invention is to provide air entrained polypropylene insulation material, polyurethane insulation material or a polyethylene material as an insulator.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
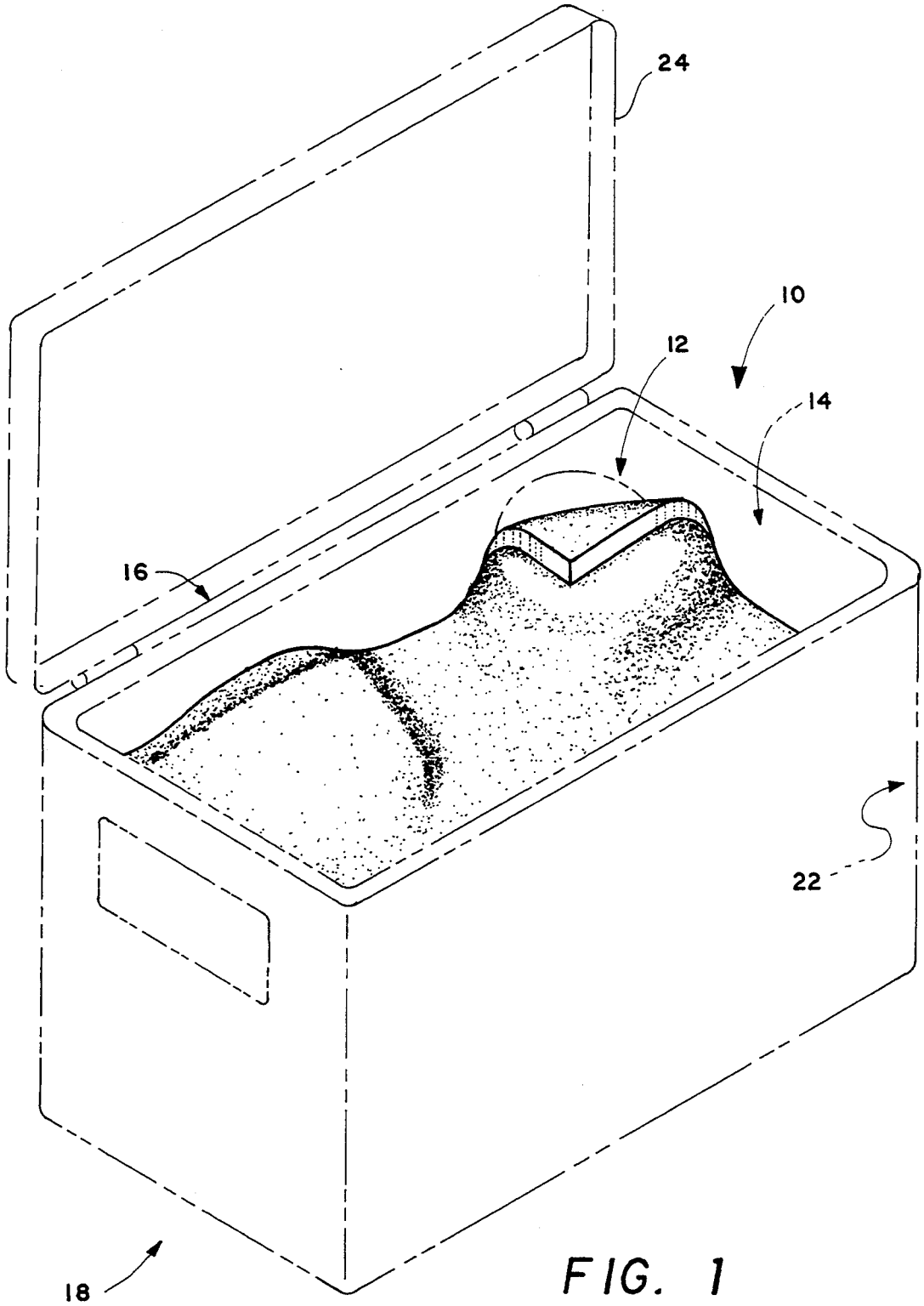
FIG. 1 is a perspective view of the invention.

Turning now to FIG. 1 of the drawings, a cooler 10 is shown, partially packed with perishables 12 and a cooling medium 14. As is seen by inspection of this drawing, there is a cavity 18 which provides an insulated chamber intended to hold and insulate contents, and there may be an unused portion 16 of the volume of cavity 18 above the contents.

A sheet 20 of insulating material is placed over perishables and cooling medium 14. A preferred insulating material is closed cell, air entrained polypropylene. Other suitable materials include foam polyurethane and foam polyethylene. Flexibility of the material, cost, insulation value and availability will determine the best choice of material.

Sheet 20 is pressed down against perishables 12 and cooling medium 14, so as to conform substantially to the upper surface collectively defined by these contents. This action divides cavity 18 into an active portion 22, defined by being occupied by perishables 12 and cooling medium 14, and unused portion 16. Of course, there is no portion 16 when the cavity 18 is completely filled.

Two consequences arise from this placement of sheet 20. The first is, obviously, division of cavity 18 into active and unused portions 22, 16. Unused, or idle portion 16 provides a benefit by creating a buffer space between active portion 22 and cover 24 of the cooler, and hence, the outside air. Since active portion 22 is cooled, a temperature differential exists between active portion 22 and outside air. With the buffer space provided by unused portion 16, heat must flow first into unused portion 16, and then into active portion 22.

The time required for this transfer of heat is increased. Because there are two zones, the temperature differential between the outside and the first zone is less than the prior differential. Rate of heat transfer from the outside to the first zone is therefore reduced. The same phenomenon is repeated between unused and active portions 16 and 22, and the total time to transfer heat is lengthened accordingly.

A second consequence of sheet 20 is that the volume of a zone of air which would otherwise surround perishables 12 and cooling medium 14 is minimized. This zone of air could support convection currents, which, with sheet 20 pressed into place, are minimized.

When the unused portion 16 does not exist, as when the cooler is entirely filled, sheet 20 still performs a very useful, insulating function, particularly with coolers that have uninsulated covers. If the cover is insulated, sheet 20 provides a valuable, extra layer of insulation.

Coolers are made in different sizes, shapes, and configurations. Since insulating material is sold in bulk, as in rolls, it is unlikely that a sheet cut from a roll will fit precisely into the footprint, or area as seen from a top plan view, of cavity 18. Therefore, the insulating material may be trimmed or cut to an appropriate, predetermined size and configuration corresponding to this footprint, or the dimensions of the cooler. Sheet 20 then drops into cavity 18, fitting precisely, and leaves neither gaps nor humps (other than those created by the contents over which sheet 20 is positioned) which would favor convection currents and conduction of heat.

Alternatively, sheet 20 may be oversized slightly, and the edges folded down onto and tucked behind the contents, against the inside walls of the cooler.

Figure 2:
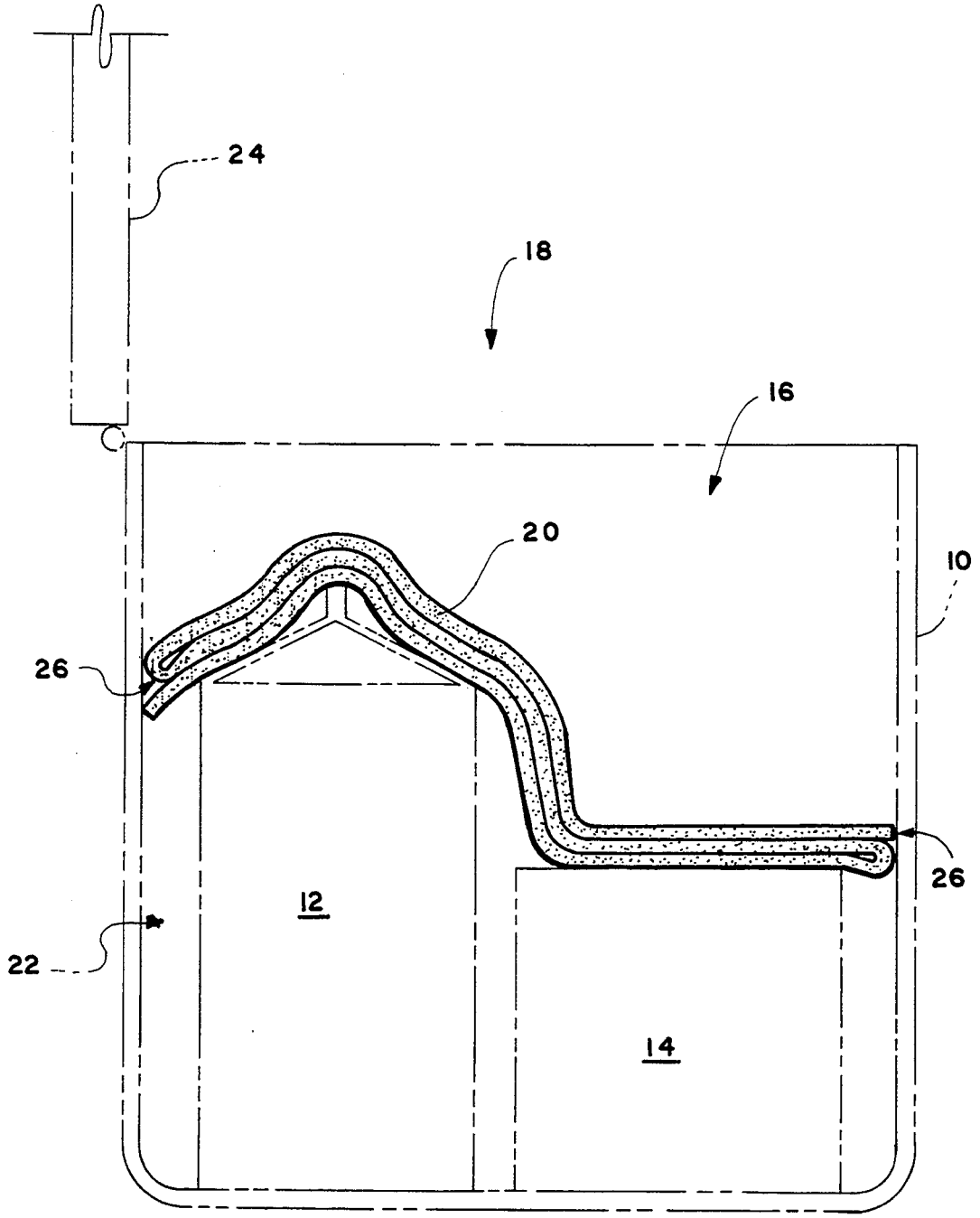
FIG. 2 is a diagrammatic, side cross sectional view of the invention.

A preferable manner of maximizing the insulation value of sheet 20 is to fold it, for example, into three close fitting, parallel layers. This is seen in FIG. 2. Conformity of sheet 20 to the upper surface of perishables 12 and cooling medium 14 is also clearly seen in this view. The benefit of folding sheet 20 is that still further dead air layers 26 are created between adjacent sections of sheet 20. Additionally, more than three layers may be provided, particularly if it is desired to completely fill the unused portion 16 with sheet 20 to even further effectively insulate the contents of the cooler.

Figure 3:
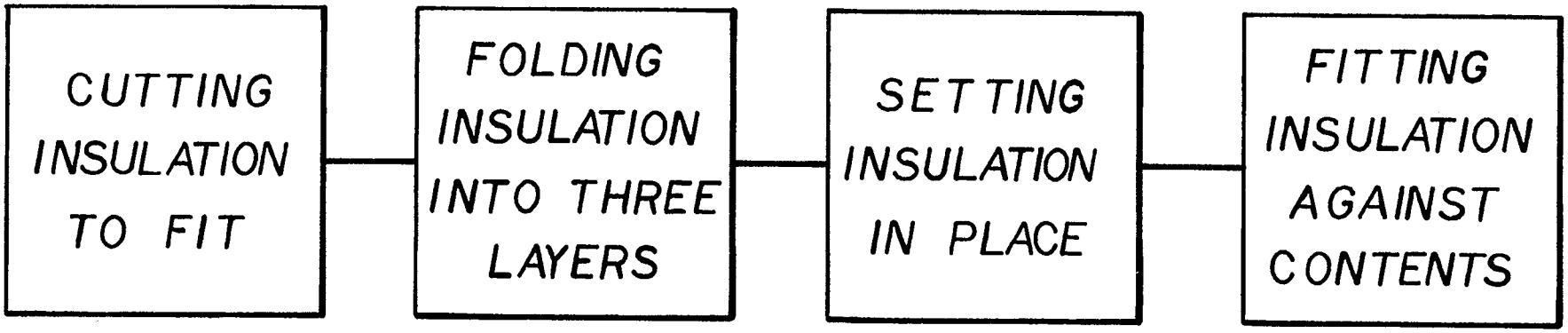
FIG. 3 is a block diagram of steps of a method of practicing the invention.

Turning now to FIG. 3, the steps of the method of practicing the invention are illustrated. Reading left to right, included is an optional first step of cutting a sheet of insulation, as from a bulk roll, to correspond to the dimensions of the cooler, and either to the footprint of the insulating chamber, or oversized somewhat, so that edges may be tucked down over the sides of the contents of the cooler.

An optional step two is the folding of the insulating material into a predetermined number of layers, such as three, to magnify the effectiveness of the insulating material. Here, it is to be understood that more than three layers may be provided, especially if it is desired to completely fill the unused space 16 with insulating material.

Main steps of the method are setting a section or sheet of insulating material of satisfactory fit in place, and pushing the sheet down over the contents of the cooler.

It is to be understood that the present invention is not limited to the sole embodiment described above, but encompasses any and all embodiments within the scope of the following claims.

We claim:

1. A method of insulating a portion of a cooler packed with perishables and cooling medium, comprising the steps of:

a) placing a flexible sheet of synthetic, thermal insulation material over the perishables and cooling medium, below the cover of the cooler; and b) configuring the flexible sheet to cover substantially the upper surface collectively defined by the perishables and cooling medium.

2. The method of claim 1, wherein step a) comprises: the step of placing a flexible sheet of synthetic, thermal insulation material over the perishables and cooling medium, and leaving unoccupied space above the flexible sheet and below the cover of the cooler.

3. The method of claim 1, wherein step a) comprises: the step of placing a sheet of air entrained foam polypropylene over the perishables and cooling medium, and leaving unoccupied space above the flexible sheet and below the cover of the cooler.

4. The method of claim 1, further including the step of:

c) folding the flexible sheet into a predetermined number of close fitting, parallel layers.

5. The method of claim 4, wherein step c) comprises: folding the flexible sheet into layers sufficient in number to fill any unoccupied space between the perishables and cooling medium, and the top of the cooler.

6. The method of claim 1, further including the step of:

d) cutting the flexible sheet to correspond, approximately, to the dimensions of the cooler.

7. A method of insulating a portion of a cooler packed with perishables and cooling medium, comprising the steps of:

a) placing a sheet of air entrained foam polypropylene over the perishables and cooling medium, and below the cover of the cooler;

b) configuring the flexible sheet to conform substantially to the upper surface collectively defined by the perishables and cooling medium; and c) folding the flexible sheet into close fitting, parallel layers.

8. The method of claim 7, wherein step c) comprises: folding the flexible sheet into a predetermined number of close fitting, parallel layers, said predetermined number being at least three.

9. The method of claim 7, further including the step of:

d) cutting the flexible sheet to correspond, approximately, to the dimensions of the cooler.

10. The method of claim 7, wherein step a) comprises: placing the sheet of air entrained foam polypropylene over the perishables and cooling medium, and leaving unoccupied space above the flexible sheet and below the cover of the cooler.

11. A method of insulating a portion of a cooler packed with perishables and cooling medium, comprising the steps of:

a) placing a sheet of air entrained foam polypropylene over the perishables and cooling medium, and below the cover of the cooler;

b) configuring the flexible sheet to conform substantially to the upper surface collectively defined by the perishables and cooling medium;

c) folding the flexible sheet into at least three close fitting, parallel layers; and d) cutting the flexible sheet to correspond, approximately, to the dimensions of the cooler.

12. The method of claim 11, wherein step a) comprises:

placing the sheet of air entrained foam polypropylene over the perishables and cooling medium, and leaving unoccupied space above the flexible sheet and below the cover of the cooler.

13. A cooler having improved insulation for perishables and cooling medium placed therein, said cooler including an insulated floor, four insulated walls, and a cover, defining therein an insulated cavity; and there being a sheet of flexible, synthetic thermal insulation disposed above the perishables in close proximity thereto and below said cover, said sheet further being configured to cover substantially the upper surface collectively defined by the perishables and cooling medium.

14. The cooler according to claim 13, said synthetic, thermal insulation comprising air entrained polypropylene.

15. The cooler according to claim 13, said sheet being folded to define at least three parallel strata, each said stratum being in close proximity to an adjacent said stratum.

16. The cooler according to claim 13, said cavity having a cross sectional area of predetermined configuration, said sheet being preformed to correspond, approximately, to said cross sectional area.

* * * * *